US007351337B1

(12) United States Patent
Milo et al.

(10) Patent No.: US 7,351,337 B1
(45) Date of Patent: Apr. 1, 2008

(54) MAGNETIC FUEL CONDITIONING APPARATUS

(76) Inventors: Chester Milo, P.O. Box 1771, Bonita Springs, FL (US) 34133; Donald Schramm, P.O. Box 380016, Murdock, FL (US) 33938

( * ) Notice: Subject to any disclaimer, the term of this patent is extended or adjusted under 35 U.S.C. 154(b) by 328 days.

(21) Appl. No.: 10/983,560

(22) Filed: Nov. 8, 2004

Related U.S. Application Data

(60) Provisional application No. 60/518,047, filed on Nov. 7, 2003.

(51) Int. Cl.
*F02M 33/00* (2006.01)

(52) U.S. Cl. ..... 210/222; 210/695; 422/186.01; 123/538

(58) Field of Classification Search ..... 210/222, 210/695; 422/186.01; 123/538
See application file for complete search history.

(56) References Cited

U.S. PATENT DOCUMENTS

| | | | | |
|---|---|---|---|---|
| 4,716,024 | A * | 12/1987 | Pera | 210/222 |
| 4,935,133 | A * | 6/1990 | Hirama | 210/222 |
| 5,882,514 | A * | 3/1999 | Fletcher | 210/222 |
| 2003/0168393 | A1 * | 9/2003 | Tsunematsu | 210/222 |

* cited by examiner

*Primary Examiner*—David A Reifsnyder
(74) *Attorney, Agent, or Firm*—William E. Noonan

(57) ABSTRACT

A fuel conditioning apparatus includes a housing having an interior chamber that extends between an inlet and an outlet. The chamber is surrounded by a threaded channel that is formed in an interior wall of the housing. A plurality of permanent magnets are carried within the chamber of the housing interiorly of the threaded channel. Like poles of adjacent magnets face one another such that each pair of adjacent magnets repel one another and define a mixing pocket that is in communication with the channel. Fuel is transmitted through the channel and the mixing pockets. Magnetic flux generated by the magnets induces energy within the fuel to resist repolymerization and the formation of particulates in the fuel.

8 Claims, 4 Drawing Sheets

MAGNETIC FUEL CONDITIONING APPARATUS

RELATED APPLICATION

This application claims the benefit of U.S. Provisional Patent Application Ser. No. 60/518,047 filed Nov. 7, 2003.

FIELD OF THE INVENTION

This invention relates to a magnetic fuel conditioning apparatus and, more particularly, to an apparatus that employs inductive energy to excite the molecules of petroleum based fuel, such as diesel fuel, so that the fuel resists repolymerization and burns more efficiently in an internal combustion engine.

BACKGROUND OF THE INVENTION

As stored diesel fuel ages, it tends to repolymerize. The molecules in the fuel have a tendency to re-bond to one another and return the fuel to a tar-like consistency. As repolymerization continues and the molecular chains become longer, particulates and sludge form in the fuel. This can clog and damage the engine. The fuel may be rendered unpumpable, and even incombustible. The foregoing problem is exacerbated by the extreme temperatures and pressures encountered as the fuel is run through a truck, motor vehicle or marine engine. Repolymerization is an especially common problem in warm weather climates where the fuel is continuously subjected to elevated temperature conditions.

Various magnetic fuel conditioners have been developed for increasing the combustion efficiency of diesel fuel. These devices typically employ magnets to induce a magnetic flux, which excites the electrons and molecules of the fuel. The goal of such devices is to produce a turbulence that enables the fuel to resist rebonding and repolymerization. Although such devices have shown some effectiveness, a serious need exists for an apparatus that excites the molecules in the fuel more vigorously so that repolymerization is more effectively resisted and improved combustion is achieved.

SUMMARY OF THE INVENTION

It is therefore an object of the present invention to provide a magnetic fuel conditioning apparatus that provides for significantly improved molecular excitement and turbulence in a petroleum based fuel so that repolymerization is more effectively resisted and improved fuel efficiency is achieved.

It is a further object of this invention to provide a magnetic fuel conditioning apparatus that achieves significantly improved fuel turbulence so that the premature production of sludge is prevented and the fuel is pumped and burned much more cleanly and successfully.

It is a further object of this invention to provide a magnetic fuel conditioning apparatus that is particularly effective for improving the combustion efficiency of diesel fuel.

It is a further object of this invention to provide a fuel conditioning apparatus that is beneficial for use in truck, motor vehicle and marine vessel engines.

It is a further object of this invention to provide a fuel conditioning apparatus that enables petroleum based fuels to burn much cleaner and leaner than has heretofore been possible using conventional fuel conditioning technology.

It is a further object of this invention to provide a fuel conditioning apparatus that is effective for use in virtually all types of internal combustion engines and which is particularly effective for use in high temperature and pressure environments.

It is a further object of this invention to provide a magnetic fuel conditioning apparatus that achieves a greater molecular turbulence than is obtained using conventional devices.

This invention features a magnetic fuel conditioning apparatus. The apparatus includes a housing having an inlet and an outlet communicably connected by an internal chamber. A plurality of permanent magnets are arranged generally linearly end to end within the chamber such that like poles of each adjacent pair of magnets face one another within the chamber. The magnetic flux generated between each adjacent pair of magnets maintains a predetermined spacing between the components. Such spacing defines a mixing pocket between the adjacent magnets. The interior wall of the housing includes a channel that is disposed exteriorly of the magnets and in communication with the spacing between each pair of magnets. The channel is in communication with the inlet and outlet of the housing. Fuel introduced to the housing through the inlet is transmitted through the channel such that the fuel passes linearly over the magnets and through the spacing (mixing pockets) between the magnets. The magnetic flux generated by the magnets excites the molecules of the fuel so that inductive energy and turbulence are imparted to the fuel. As a result, cleaner, more efficiently combustible fuel is produced. This fuel is eventually discharged through the outlet.

In a preferred embodiment, the channel may include a single acme thread that extends between the inlet and outlet of the housing. Alternatively, for larger units requiring a greater flow of fuel, the channel may include opposing left-hand and right-hand threads. The threads may be defined by a plurality of alternating, generally diamond-shaped elements that are mounted in a generally interleaved manner on respective halves of the housing.

DETAILED DESCRIPTION OF PREFERRED EMBODIMENT

Other objects, features and advantages will occur from the following description of preferred embodiments and the accompanying drawings, in which.

Figure 1:
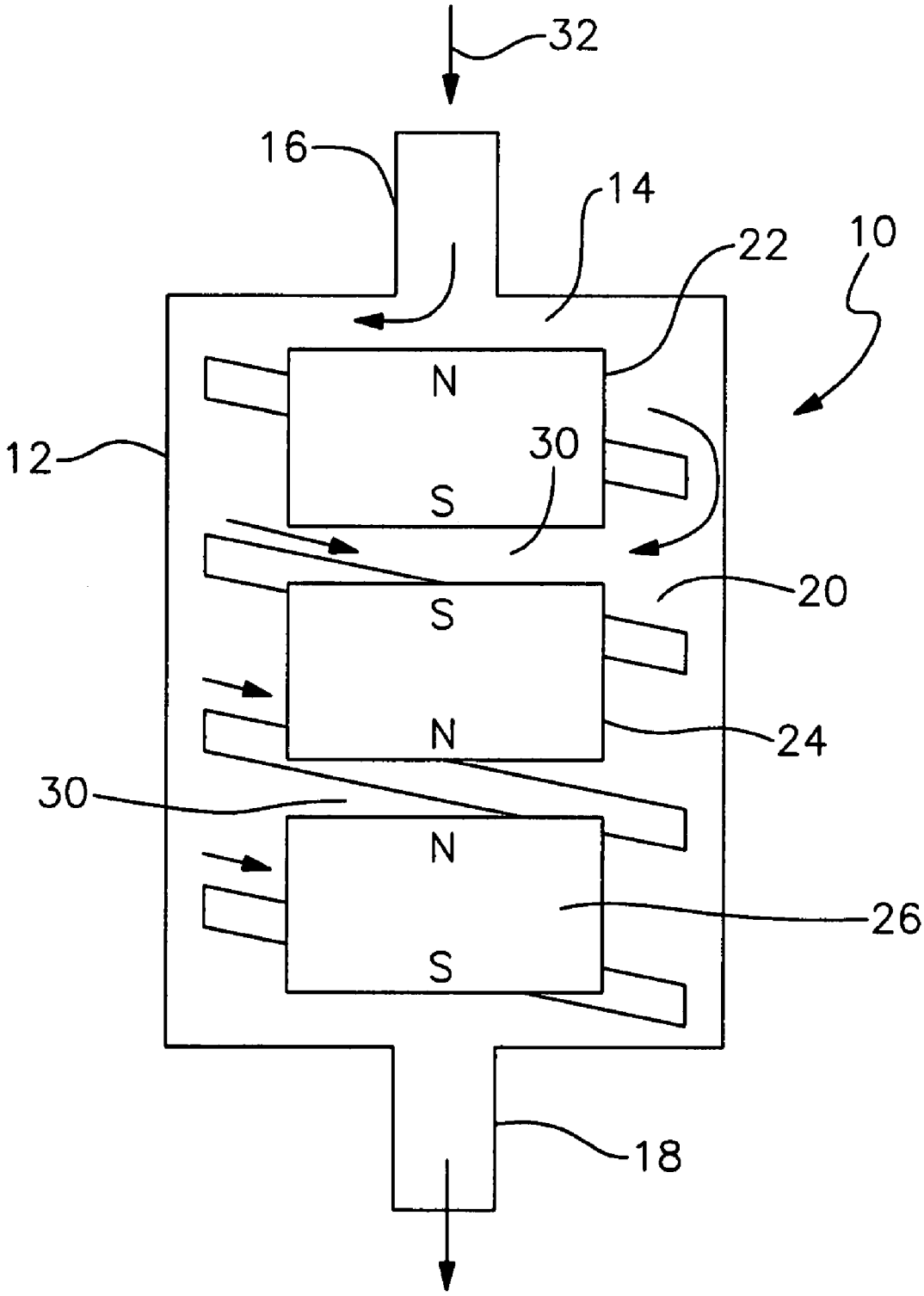
FIG. 1 is an elevational schematic view of a preferred version of the fuel conditioner that is utilized on a relatively small engine.

There is shown in FIG. 1 a magnetic fuel conditioning apparatus 10 designed to improve the efficiency of diesel fuel, as well as other petroleum based fuels of the type utilized in motor vehicle and marine engines. The particular variety of fuel employed and the particular type of engine in which the conditioner is mounted are not limitations of this invention. Virtually all sorts of internal combustion engines may employ the fuel conditioner.

Figure 2:
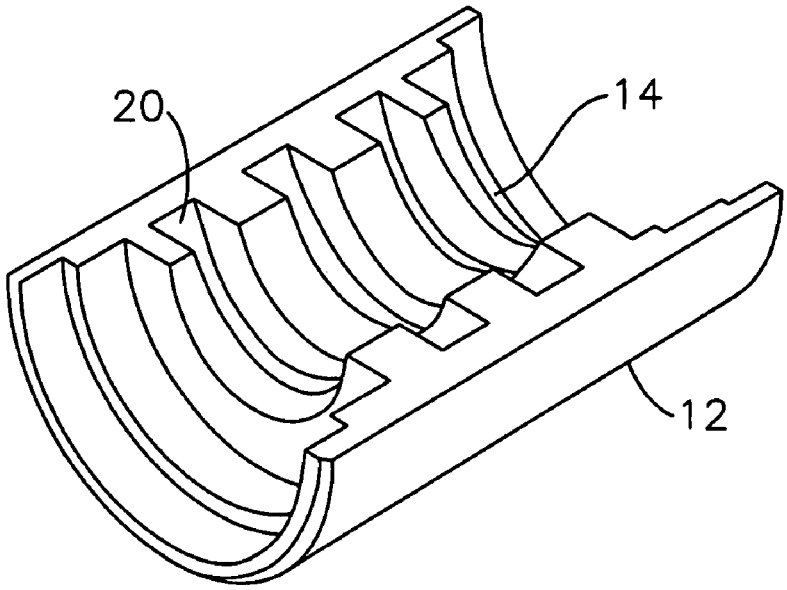
FIG. 2 is a perspective fragmentary view of one half of the housing used in the embodiment of FIG. 1.

Fuel conditioner 10 includes a substantially cylindrical housing 12, a fragmentary half-section of which is shown in FIG. 2. The housing features an interior chamber 14 that extends between and is communicably interconnected to an inlet 16 and an outlet 18. The interior surface of cylindrical housing 12 includes a screw thread channel 20, which may include, but is not limited to, an acme thread. The threaded channel is machined or otherwise formed in the interior surface of the housing between the inlet 16 and outlet 18. Channel 20 surrounds and communicates with the central chamber of the housing. A left-hand thread is shown in FIGS. 1 and 2. However, it should be understood that the channel may feature a right-hand thread in alternative versions.

A plurality of permanent magnets 22, 24 and 26 are arranged generally linearly (e.g. aligned) within chamber 14 interiorly of channel 20. The magnets, which typically have circular cross sectional shapes, are arranged with like poles (N, S for north and south, respectively) facing one another such that a repulsive magnetic flux is generated between each adjacent pair of magnets. As a result, a predetermined spacing or gap (based upon the strength of the flux) is formed between each adjacent pair of the magnets. The spacing is typically about ¼", although alternative dimensions may be employed within the scope of this invention. This gap defines a mixing pocket 30. The mixing pockets comprise a part of chamber 14 and are in communication with the internal thread or channel 20 of housing 12.

In operation, conditioner 10 is interconnected to the fuel line (not shown) of an engine such that inlet 16 and outlet 18 are joined to respective segments of the line. Diesel or other petroleum-based fuel is delivered to the fuel conditioner 10, as indicated by arrow 32 in FIG. 1. The fuel enters inlet 16 and travels along threaded channel 20 toward outlet 18. As the fuel is transmitted along the threaded channel it passes longitudinally over magnets 22, 24 and 26. The fuel also flows into the mixing pockets 30 between the magnets. The flux generated by magnets 22, 24 and 26 tends to excite the molecules of the fuel both within threaded channel 20 and especially within the mixing pockets 30. Energy and turbulence are induced in the fuel, which cause the fuel to effectively resist repolymerization. As a result, the formation of sludge, tar and particulates is abated (or at least significantly reduced) and the fuel burns more efficiently.

In the alternative embodiment shown in FIGS. 3-7, fuel conditioner 10*a* again employs a generally cylindrical housing 12*a*. The housing includes a central opening or chamber 14*a*. In this version, opposing left-handed and right-handed threads are formed in the interior surface of the housing. This defines a fuel-transmitting channel that permits a greater flow of fuel to pass through the housing so that the conditioner 10*a* may be utilized effectively on larger engines.

Figure 3:
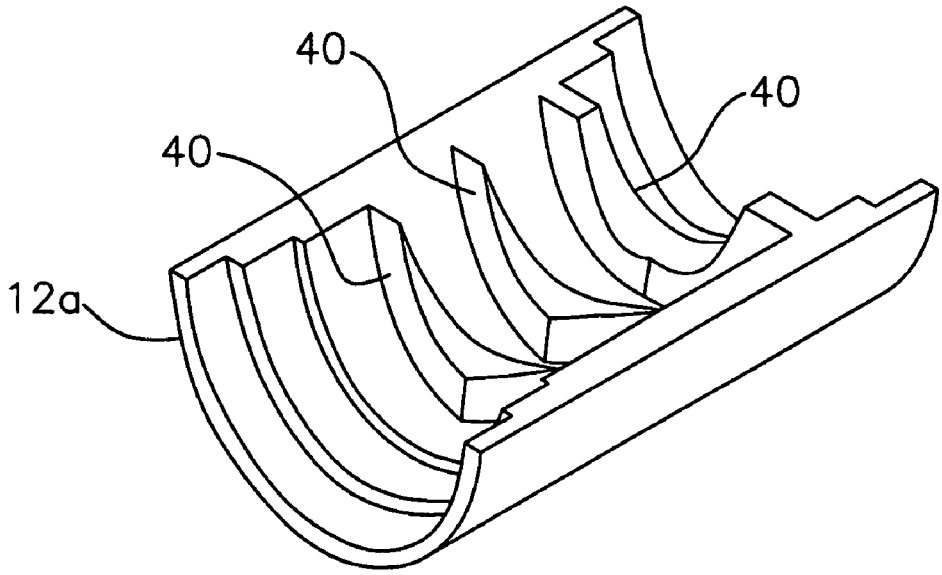
FIG. 3 is a perspective view of one-half of the housing of an alternative fuel conditioner of this invention, which is intended for use on larger engines; the housing employs opposing left-hand and right-hand threads that are formed by diamond-shaped elements carried on the interior wall of the housing.
Figure 4:
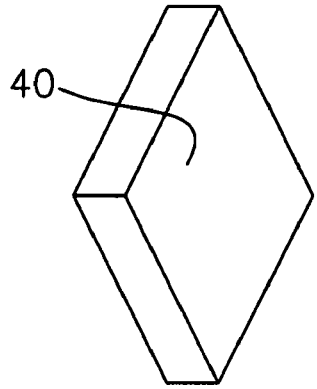
FIG. 4 is a perspective view of a representative one of the diamond-shaped elements arranged in a substantially flat condition for clarity.
Figure 5:
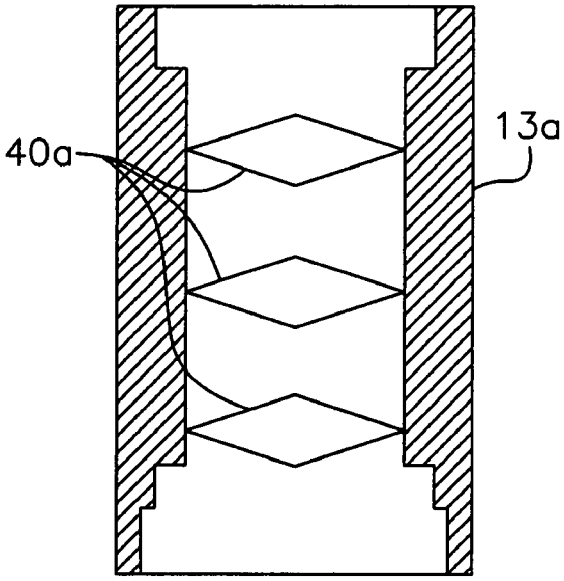
FIG. 5 is an elevational front view of the component shown in FIG. 3.
Figure 6:
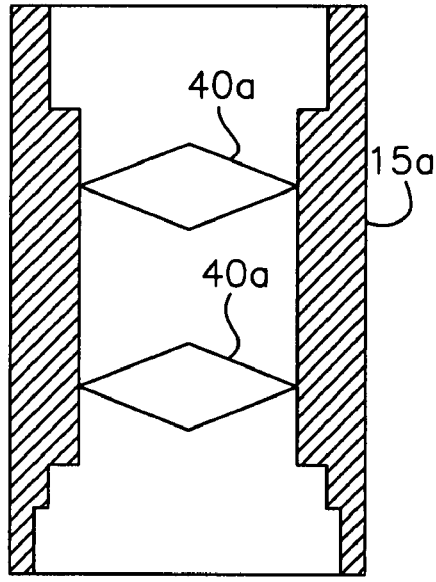
FIG. 6 is an elevational front view of the second complementary half section of the housing, which employs a pair of diamond-shaped components that are interleaved with the three diamond-shaped components carried by the other half section of the housing.

A first half section 13*a* of housing 12*a* is depicted in FIGS. 3 and 5. A complementary second half section 15*a* is depicted in FIG. 6. The opposing left-hand and right-hand threads are defined by a plurality of diamond-shaped components 40*a*, shown alone and flattened for clarity in FIG. 4, which are mounted to the interior wall of the housing. More particularly, housing 12*a* includes a pair of joined half sections 13*a*, 15*a*, that define the cylindrical and internally threaded housing. Three diamond-shaped components 40*a* are formed in a spaced apart relationship on the interior wall of one of the half sections 13*a*. The other section, 15*a*, FIGS. 6 and 7, carries two of the diamond-shaped components 40*a*. The diamond-shaped components on half sections 13*a* and 15*a* are arranged in an alternating fashion such that they are generally interleaved in a manner best shown in FIG. 7. The generally flat diamond component, shown in FIG. 4, is actually curved along the interior wall of each half portion of the housing in the manner best shown in FIG. 3. One or more of the tips or points of the diamonds may be truncated or cut-off as shown by the uppermost diamond in FIG. 3. Half sections 13*a* and 15*a* may comprise separate pieces that are assembled or a single unitary piece that is machined or cast. In either case, the alternating interleaved diamond components 40*a* define left and right-hand threads which serve as channels to transmit fuel in generally opposing spiral or screw thread directions longitudinally through the interior of housing 12*a* from an inlet end (at the top of the conditioner) to an outlet end (at the bottom of the conditioner).

A plurality of permanent magnets 22*a*, 24*a* and 26*a* are again mounted within the internal chamber 14*a* of housing 12*a* such that the diamond-shaped, thread defining components 40*a* are disposed peripherally about the magnets. As in the prior embodiment, the permanent magnets are aligned within chamber 14*a* such that like poles of the magnet face one another. This causes the adjacent magnets to repel one another so that an interior space or mixing chamber 30*a* having a predetermined distance is formed between each adjacent pair of magnets. These mixing chambers are again in communication with the left-hand and right-hand threads formed in the interior wall of the housing. A flange, lip, cap, end wall or other structure (not shown) may be disposed at each end of housing 12*a* for retaining the magnets within the chamber. The inlet and outlet are formed through such structure into the chamber.

Figure 7:
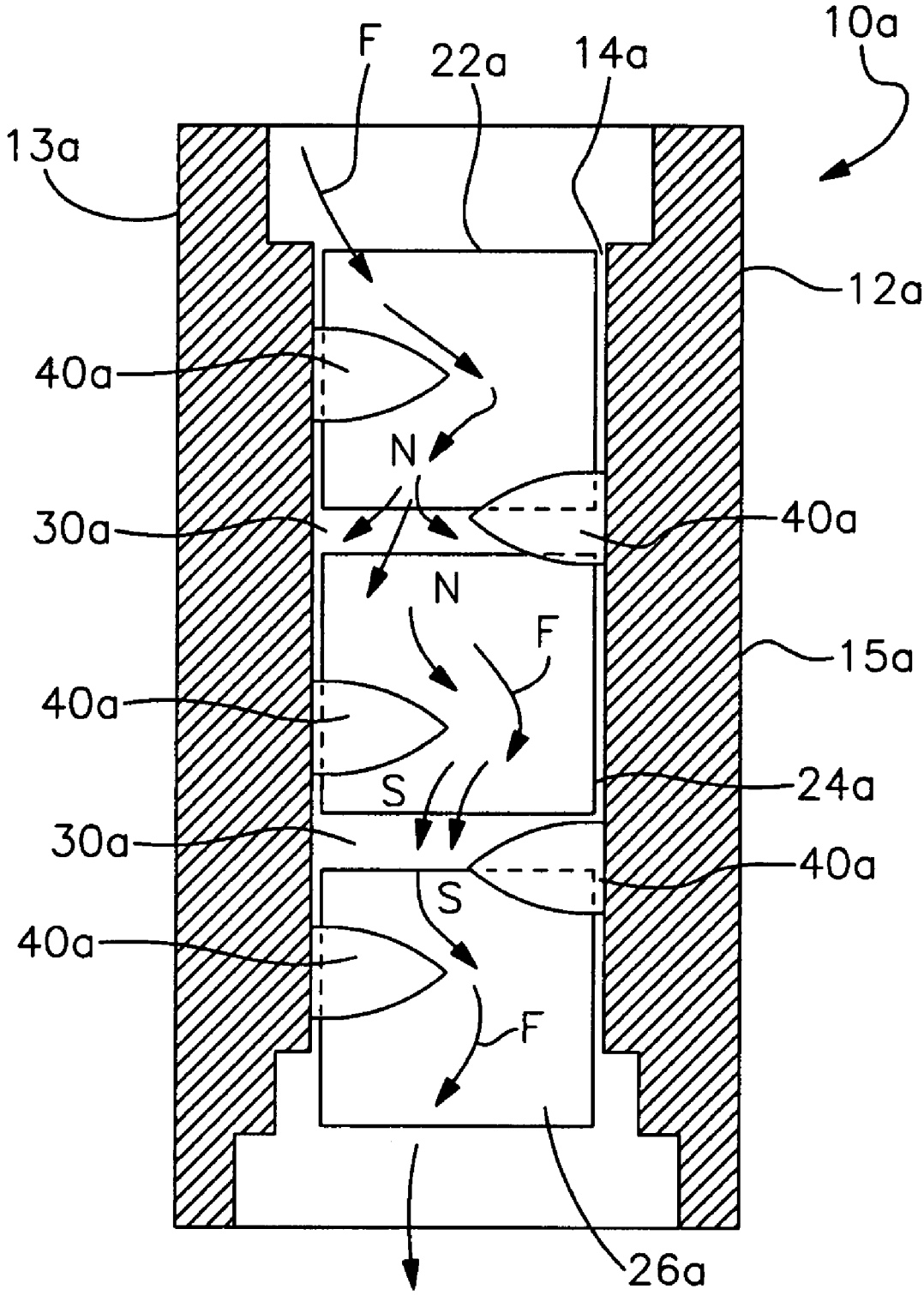
FIG. 7 is an elevational, cross sectional and partly schematic view of the version used on larger engines.

In operation, the fuel is introduced into the inlet of housing 12*a* in the manner shown in FIG. 7 and in a manner analogous to that described in connection with the single threaded channel embodiment. Fuel is transmitted by the left-hand and right-hand internal threads defined by components 40*a* through the interior chamber of the housing and toward the discharge outlet. See arrows F. As the fuel is transmitted through the housing, it passes across the exterior longitudinal surfaces of magnets 22*a*, 24*a* and 26*a* and enters the mixing pockets 30. The magnets induce energy (i.e. excite the molecules) in the fuel so that turbulence is increased, repolymerization is resisted and improved fuel efficiency is achieved.

It is critical that the magnets be arranged within the housing of the fuel conditioner in the manner described above so that an improved magnetically induced energization of the fuel is achieved. Prior art fuel conditioners utilize magnets, which are almost invariably joined or otherwise constructed so that the fuel passes only along the longitudinal length of the adjoining magnets. In no known device is fuel introduced into the gaps or mixing pockets formed between adjacent pairs of magnets arranged with their like poles facing one another. In present invention, the adjoining magnets include like poles that do indeed face one another. This causes the magnets to repel. A particularly powerful magnetic field and resulting flux are formed within the chamber and especially between each pair of opposing magnets. This flux causes significantly improved excitement and turbulence in the electrons and molecules of the fuel. As a result, improved resistance to repolymerization and the resulting formation of tars, sludge and particulates is achieved.

Due to the improved fuel efficiency provided by the conditioning apparatus of this invention, a number of significant benefits are obtained. Diesel fuel especially is rendered more pumpable and combustible. Engine clogging is avoided and performance is improved. The fuel is able to sit in storage for much longer periods and is able to withstand a hot and/or high-pressure environment without deteriorating significantly.

In alternative embodiments, various other numbers and configurations of channels may be employed. For example, multiple spiral or acme threads may be formed side by side in the interior wall of the housing. The thread(s) may have assorted dimensions. In still other versions, the channel may be formed by an annular portion of the chamber formed between the interior wall and the exterior of the magnets. Spiral threads are particularly preferred because such structure increases the turbulence of the fuel, which in turn retards repolymerization and its adverse effects. Multiple spirals are particularly effective in enhancing this turbulence.

From the foregoing it may be seen that the apparatus of this invention provides for an improved fuel conditioning apparatus that uniquely features adjoining pairs of magnets having like poles facing one another to create mixing pockets for the fuel. The mixing pockets uniquely exhibit a strong magnetic flux that more effectively induces energy in the fuel transmitted through the conditioner so that repolymerization is resisted and improved fuel efficiency and performance are achieved.

While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. A magnetic fuel conditioning apparatus comprising:

a housing having an interior chamber of a predetermined length;

an inlet for introducing fuel into said chamber;

an outlet for discharging fuel from said chamber;

a plurality of permanent magnets aligned within said chamber, said aligned magnets having an overall length that is less than the predetermined length of said chamber, with like poles of adjacent magnets facing one another for generating a magnetic flux that urges said adjacent magnets spatially apart to form a void between said adjacent magnets, which void extends transversely between said adjacent magnets across the entire face of each of said like poles facing one another, said void forming a fuel-mixing pocket between said adjacent magnets; and a fuel transmitting channel extending through said chamber and passing over said magnets, said channel including an elongate screw thread attached to an interior peripheral wall of said chamber and wound exteriorly about said magnets, said channel communicably interconnecting said inlet and said outlet and in communication with said fuel mixing pocket, whereby fuel introduced into said chamber from said inlet is transmitted through said channel for passing over said magnets and through said mixing pocket such that the magnetic flux induces energy and turbulence in the fuel.

2. The apparatus of claim 1 in which at least three permanent magnets are aligned within said chamber.

3. The apparatus of claim 1 in which said adjacent magnets are held spatially apart exclusively by the magnetic flux generated by said adjacent magnets.

4. The apparatus of claim 1 in which the aligned magnets have respective longitudinal outer surfaces and in which the mixing pocket extends transversely through the chamber interiorly of the longitudinal outer surfaces of said adjacent magnets.

5. A magnetic fuel conditioning apparatus comprising:

a housing having an interior chamber;

an inlet for introducing fuel into said chamber;

an outlet for discharging fuel from said chamber;

a plurality of permanent magnets aligned within said chamber with like poles of adjacent magnets facing one another for generating a magnetic flux that urges said adjacent magnets apart to form a fuel-mixing pocket between said adjacent magnets; and a fuel transmitting channel extending through said chamber and passing over said magnets, said channel communicably interconnecting said inlet and said outlet and in communication with said fuel mixing pocket, whereby fuel introduced into said chamber from said inlet is transmitted through said channel for passing over said magnets and through said mixing pocket such that the magnetic flux induces energy and turbulence in the fuel, said channel including an elongate screw thread attached to an interior peripheral wall of said chamber and wound exteriorly about said magnets.

6. The apparatus of claim 5 in which said channel includes a single acme screw thread.

7. A magnetic fuel conditioning apparatus comprising:

a housing having an interior chamber;

an inlet for introducing fuel into said chamber;

an outlet for discharging fuel from said chamber;

a plurality of permanent magnets aligned within said chamber with like poles of adjacent magnets facing one another for generating a magnetic flux that urges said adjacent magnets apart to form a fuel-mixing pocket between said adjacent magnets; and a fuel transmitting channel extending through said chamber and passing over said magnets, said channel communicably interconnecting said inlet and said outlet and in communication with said fuel mixing pocket, whereby fuel introduced into said chamber from said inlet is transmitted through said channel for passing over said magnets and through said mixing pocket such that the magnetic flux induces energy and turbulence in the fuel, said channel including opposing left-hand and right-hand screw threads carried by an interior peripheral wall of said chamber and wound exteriorly about said magnets.

8. The apparatus of claim 7 in which said threads include a plurality of alternating, generally diamond-shaped elements that are mounted in a generally interleaved manner on respective half segments of said housing.

* * * * *